US005893498A

United States Patent [19]

Aronson

[11] Patent Number: 5,893,498

[45] Date of Patent: Apr. 13, 1999

[54] SOCKET RETAINING UTILITY BELT

[76] Inventor: Gina E. Aronson, 4030-54th St. S., Clinton, Iowa 62732

[21] Appl. No.: 08/992,122

[22] Filed: Dec. 17, 1997

[51] Int. Cl.[6] ..... A45F 5/00

[52] U.S. Cl. ..... 224/255; 24/3.11; 24/3.12; 206/378; 224/254; 224/904

[58] Field of Search ..... 224/254, 255, 224/904, 918; 206/493, 378, 377, 379; 24/3.12, 3.11, 616; 285/39, 921

[56] References Cited

U.S. PATENT DOCUMENTS

| | | | |
|---|---|---|---|
| 3,540,727 | 11/1970 | Hoe, Jr. | 473/386 |
| 3,886,773 | 6/1975 | McGahee | 224/255 |
| 4,765,470 | 8/1988 | Curci . | |
| 4,923,105 | 5/1990 | Snyder | 224/255 |
| 4,930,628 | 6/1990 | Bridges . | |
| 5,108,287 | 4/1992 | Yee et al. . | |
| 5,139,144 | 8/1992 | Robert, Jr. . | |
| 5,203,469 | 4/1993 | Chang et al. . | |
| 5,326,068 | 7/1994 | Spears . | |
| 5,341,975 | 8/1994 | Marinescu . | |
| 5,511,705 | 4/1996 | Dreszer . | |
| 5,512,165 | 4/1996 | Liu . | |
| 5,573,116 | 11/1996 | Zink . | |
| 5,725,107 | 3/1998 | Dembricks | 211/70.6 |
| 5,743,394 | 4/1998 | Martin | 206/378 |

*Primary Examiner*—Allan N. Shoap
*Assistant Examiner*—Maerena W. Brevard
*Attorney, Agent, or Firm*—Leydig, Voit & Mayer Ltd.

[57] ABSTRACT

A socket retaining mechanism to allow maintenance or construction personnel to quickly identify and gain access to a particularly sized socket. The present invention provides a socket retaining mechanism, preferably adapted to be worn on a utility belt, wherein a plurality of socket retaining mechanisms are strung from the utility belt, with each socket retainer being adapted to hold a particular socket. Each socket retainer includes means for retaining a socket thereon, and means for releasing a socket therefrom when it is so desired by the worker. As opposed to prior art systems, the present system increases the efficiency of the worker in that less time is required for searching for the socket of interest.

17 Claims, 3 Drawing Sheets

SOCKET RETAINING UTILITY BELT

FIELD OF THE INVENTION

The present invention generally relates to hand tools, and more particularly relates to means for individually retaining sockets for easy access by users.

BACKGROUND OF THE INVENTION

Sockets, socket sets, and socket wrenches are common types of hand tools which are used by various maintenance and construction personnel to facilitate attachment and detachment of nuts and bolts typically having hexagonal heads. Depending upon the size of the hexagonal head, an appropriately sized socket will be used to attach to the head for rotation thereof. The actual rotation can be generated either by hand using a wrench, ratchet, or otherwise, or with a power tool which generates the force necessary for rotation. Such sockets can be manufactured to correspond to shapes other than conventional hexagonal heads, and in addition, can be sized to accommodate both the U.S. and Metric standards of measurement.

If a particular user of such a socket set is located or positioned such that an entire tool box or socket set can be made available for ready access to the variously sized sockets, various trays and holding mechanisms can be used to lay out the sockets in descending or ascending order according to size to allow the user to quickly identify and grasp the socket of interest. U.S. Pat. No. 5,573,116 discloses such a tray which displays variously sized sockets for access by a user.

However, certain maintenance and construction personnel are required to be mobile and as a result are limited in the quantity of tools which can be carried about the work site. Various means have therefore been developed to allow a worker to carry certain specifically defined tools through the use of a utility belt or the like. For example, U.S. Pat. No. 5,512,165 discloses a personal tool box which can be attached to a utility belt and, through the use of a plurality of shelves, can pivot about a portion of the tool box to allow the user to access variously sized tools including sockets. However, such a system is bulky and prone to inadvertent disengagement of the tools and sockets from the tool box.

Alternatively, a loop or strand of cable or wire can be formed to allow for the sockets to be strung end-to-end on the loop with a means being provided to close the loop to retain the sockets thereon. U.S. Pat. No. 5,139,144 discloses such a system wherein the loop can be carried about by the user. However, since the sockets are strung end-to-end on the loop, unless the socket of interest is the one closest to the end of the loop, a number of sockets will necessarily have to be removed to allow access to the socket of interest, which in turn will require the undesired sockets to be restrung upon the loop after the desired socket is removed. This necessarily results in a slow and frustrating process.

The problems indicated above especially manifest themselves when the maintenance or construction worker is required to act quickly, and therefore does not have the luxury of removing a number of sockets strung end-to-end upon a loop, or searching through a number of different compartments to find the socket of interest. For example, a maintenance worker required to keep a production machine on-line quite often has to make quick decisions for quick repairs which therefore requires that the worker not waste time in searching for the tool required for the given job. A system which would allow the worker to gain quick identification and access of the tool or socket of interest would therefore result in a more efficient worker, and ultimately in lower cost of maintenance or manufacture in the product or system with which the worker is associated.

SUMMARY OF THE INVENTION

It is therefore a primary aim of the present invention to provide a means by which sockets can be individually retained by a mobile maintenance or construction worker as he or she moves about a work site.

It is an objective of the present invention to provide a utility belt to be worn by construction or maintenance personnel which allows for easy identification and access of the particular socket of interest.

It is another objective of the present invention to provide a socket retaining system which decreases the time necessary for identification and access of the socket of interest.

It is yet another feature of the present invention to provide a socket retaining mechanism which includes a reliable system for retaining the individual sockets on the socket retainer as well as reliably detaching the sockets therefrom.

In accordance with these aims and objectives, it is a feature of the present invention to provide a socket retaining mechanism comprising an elongated body including a first end and a second end, means for releasably retaining a socket located proximate the second end, and means for attaching the socket retaining mechanism to a utility belt.

It is another feature of the present invention to provide a socket retaining mechanism as described above wherein the elongated body includes a channel being open at the bodies second end, and the means for releasably retaining the socket is disposed within the body channel. The means for releasably retaining the socket is a lever arm disposed within the body channel which is pivotally attached to the elongated body proximate the second end. The socket retaining mechanism includes a spring loaded between the lever arm and the body channel, and the lever arm includes a head protruding through the channel as a result of the spring. A lock bar spans the body channel such that the lever arm is held within the body channel between the spring and the lock bar. The lever arm further includes a lip proximate the second end which is adapted to protrude through the body channel and engage a socket for retention thereof when the spring is expanded, and which is adapted to recede into the body channel to release the socket when the spring is compressed.

It is another feature of the present invention to provide a socket retaining mechanism wherein the means for attaching the socket retaining mechanism to a utility belt includes an aperture proximate the first end through which the utility belt can pass.

It is a still further feature of the present invention to provide a utility belt adapted to store sockets of varying size in independent fashion and allow quick release of the sockets therefrom. The utility belt includes a strand of wire strung from the utility belt, a plurality of socket retainers attached to the strand of wire, and means for releasing the strand of wire from the utility belt to add or subtract individual socket retainers.

These and other objects and advantages of the invention will become more apparent from the following detailed description when taken in conjunction with the accompanying drawings.

Figure 1:
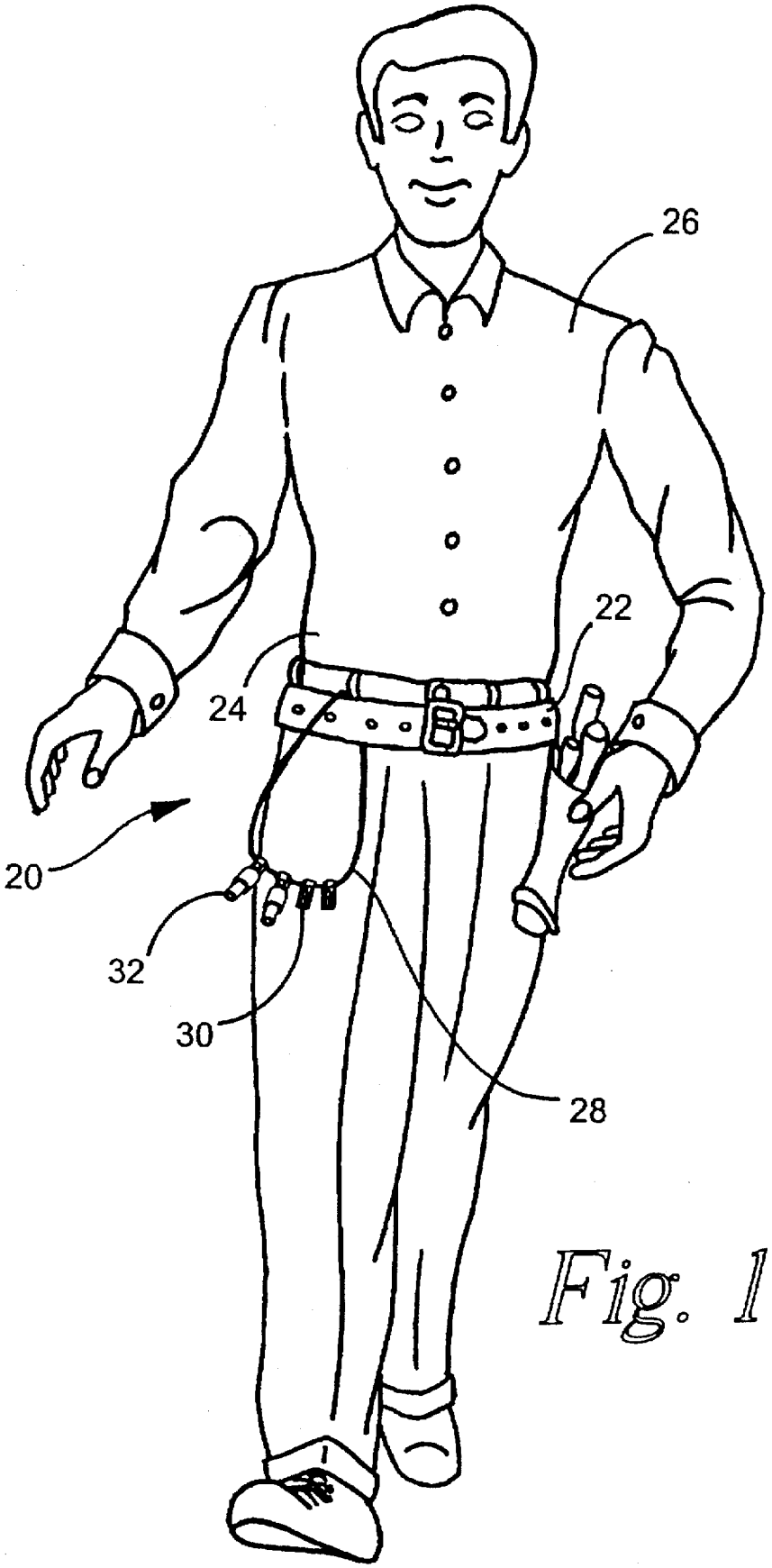
FIG. 1 is a perspective view of the preferred embodiment of the present invention as worn by a typical user.

While the present invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings, the preferred embodiment of the present invention is shown as socket retaining system 20. As shown therein, system 20 is preferably adapted to be worn in the form of a utility belt 22 about the waist 24 of the worker 26. As discussed above, a variety of means have been developed to allow a worker to carry variously sized sockets about a given job site, but each requires a substantial investment of time in searching for the particular socket of interest, as well as allowing access to the particular socket of interest. In stark contrast to such prior art devices, the present invention provides a system by which a worker who is required to be mobile about a job site to carry sockets about the job site in an organized fashion to allow the worker to quickly identify and gain access to the particular socket of interest.

In this preferred form, such objectives are obtained by providing a strand of wire 28 which is fastened to utility belt 22. In alternative embodiments, strand of wire 28 can in fact be strung about the entire waist 24 of worker 26 in lieu of utility belt 22. However, in the preferred embodiment of the present invention strand of wire 28 is actually attached to an existing utility belt 22 to allow the user to carry tools in addition to sockets along with utility belt 22.

As shown in FIG. 1, a plurality of socket retainers 30 are strung on wire 28 in side-by-side fashion. Sockets 32 of varying size can be strung from retainers 30 typically in descending or ascending order, to allow the user to quickly identify the socket of interest. Sockets 32, as is conventional, include one opening corresponding to the size of the given nut or bolt, and at another opening having a standard size for attachment to a socket wrench or drill. The size of socket retainers 30 therefore correspond to the size of the socket opening adapted to be attached to a socket wrench.

Figure 2:
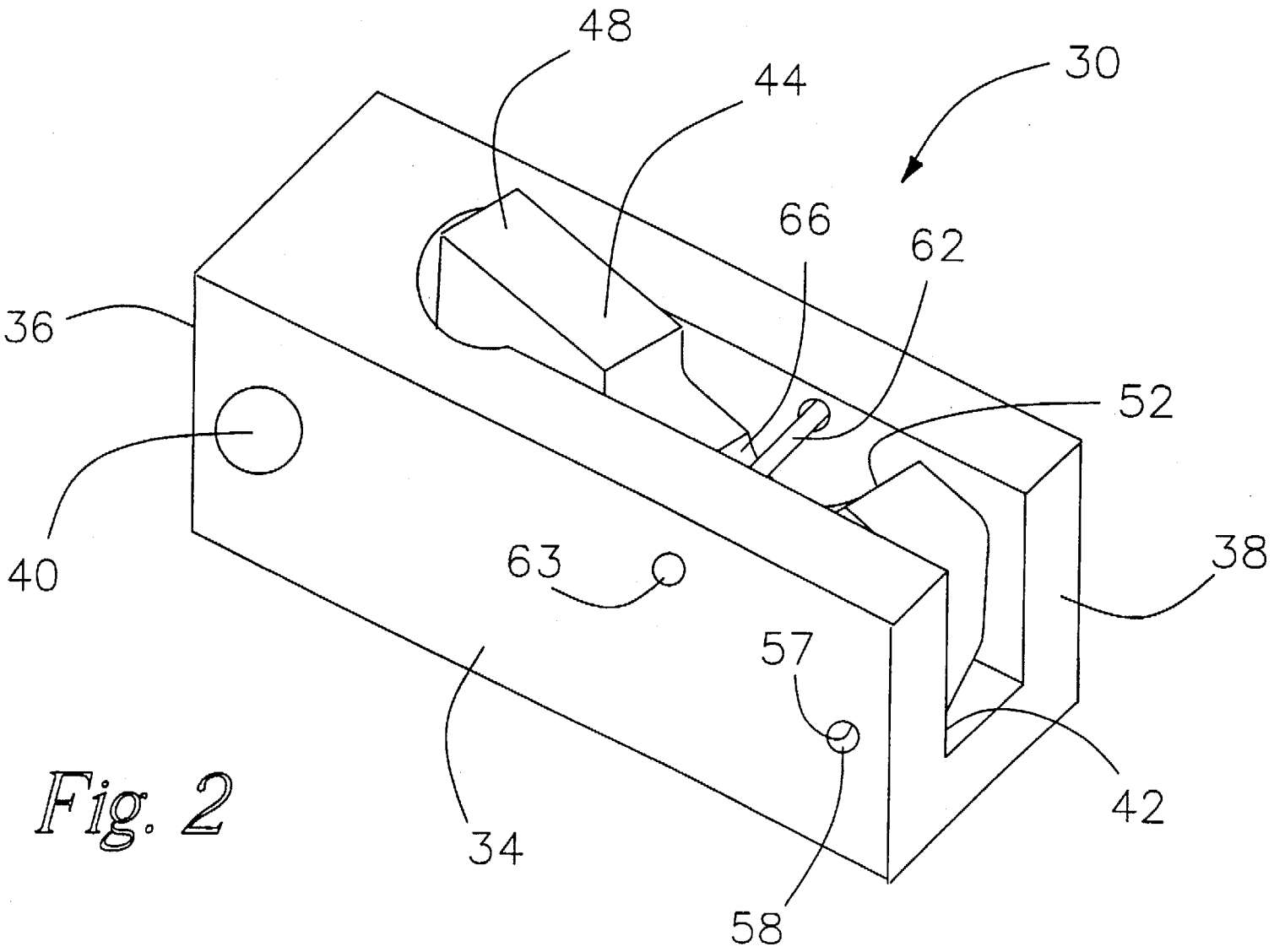
FIG. 2 is an enlarged perspective view of an individual socket retainer.
Figure 4:
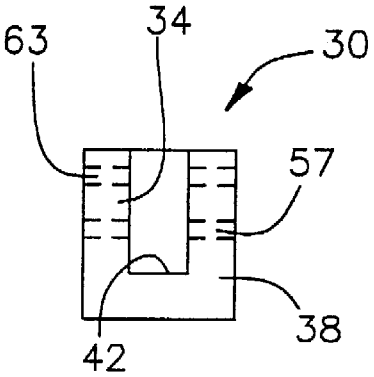
FIG. 4 is a end view of the socket retainer shown in FIG. 3.
Figure 6:
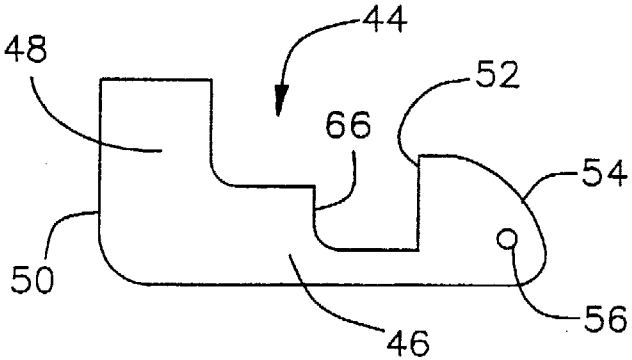
FIG. 6 is a plan view of the lever arm used in the preferred embodiment of the present invention.

Referring now to FIG. 2, socket retainers 30 are shown in greater detail as primarily comprised of an elongate body 34 having first end 36 and second end 38. First end 36 is provided with aperture 40 which is sized to accommodate strand 28 and thereby allow socket retainer 30 to be strung from utility belt 22. Second end 38 on the other hand, as best shown in FIG. 4, includes a channel 42 which runs from second end 38 the length of elongate body 34 to approximately the position of aperture 40. Channel 42 is provided to accommodate lever arm 44 therein. As best shown in FIG. 6, lever arm 44 also includes a substantially elongated body 46 having head 48 at first end 50 and lip 52 at second end 54. It can also be seen that second end 54 includes aperture 56 and elongate body 34 includes apertures 57 through which pivot 58 passes to attach lever arm 44 to elongated body 34. Pivot 58 therefore allows lever arm 44 to be rotatably attached to elongated body 34.

Figure 3:
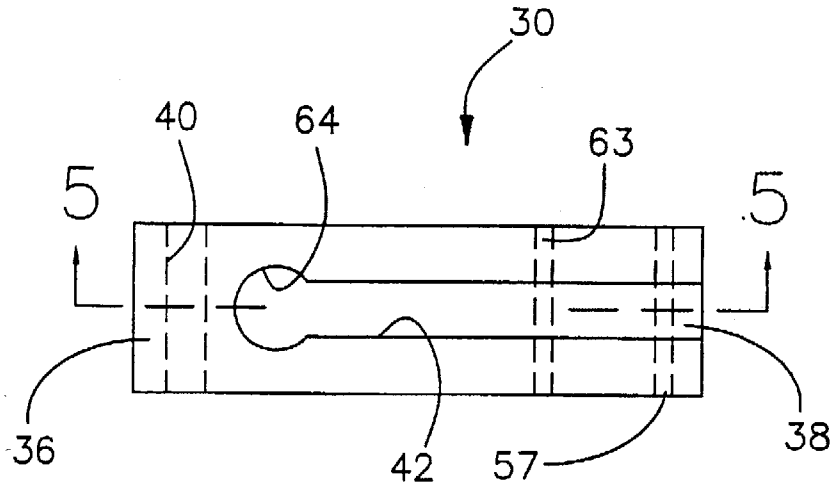
FIG. 3 is a top view of the socket retainer shown in FIG. 2, without the lever arm, spring, and lock bar.
Figure 5:
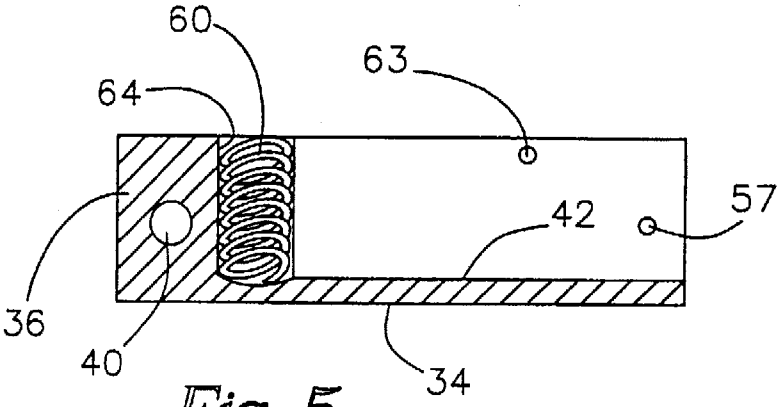
FIG. 5 is a sectional view of the socket retainer taken along line 5—5 of FIG. 2, with the spring included.

The actual position of lever arm 44 within elongated body 34 is dictated by the opposing forces of spring 60 and lock bar 62. As best shown in FIGS. 3 and 5, spring 60 is provided within cylindrical recess 64 and is so situated to correspond to head 48 of lever arm 44. Under normal operating conditions, spring 60 exerts an outward force against lever arm 44 which forces head 48 to protrude from channel 42. In addition, the outward force of spring 60 causes lip 52 of lever arm 44 to also protrude from channel 42, the importance and function of which will be described in greater detail herein. In order to retain lever arm 44 within channel 42, and not allow spring 60 to force lever arm 44 completely out of channel 42, lock bar 62 is attached to elongated body 34 through apertures 63 and spans across channel 42 as best shown in FIG. 3. Lever arm 44 includes a recess 66 which is adapted to receive lock bar 62 when spring 60 is able to force lever arm into the normal operating position.

With regard to the interaction of socket retainers 30 with individual sockets 32, it can be seen that when spring 60 is able to force lever arm 44 from channel 42, lip 52 protrudes from channel 42 as well. It can also be seen that elongated body 34 includes a square cross-section (see FIG. 4) sized accordingly to be received within an aperture of socket 32. The outward force of spring 60 forces lip 52 to engage socket 32 and retain socket 32 thereto. Specifically, lip 52 engages a shoulder positioned radially outward from the aperture of socket 32.

When it is desired by the worker to release socket 32 from socket retainer 30, he or she is able to depress head 48 of lever arm 44 into channel 42 and thereby force lip 52 of lever arm 44 into channel 42. This in turn causes lip 52 to move out of engagement with the shoulder of socket 32 to allow the user to pull socket 32 from elongated body 34 for useful work.

After the worker has completed the job requiring a given socket 32, the socket 32 can be reattached to the elongated body 34 in a reverse fashion such that the force of socket 32 being received on elongated body 34 causes lip 52 of lever arm 44 to be forced into channel 42. Once socket 32 is forced onto elongated body to a position such that the shoulder moves past lip 52, spring 60 will force lever arm 44, and accordingly lip 52, to protrude from channel 42 and again engage the shoulder of socket 32 for attachment of socket 32 to socket retainer 30.

As opposed to prior art systems, it can therefore be seen that the present invention provides a new and improved system which allows a user to quickly identify and gain access to the particular socket and socket size of interest. Moreover, the system allows the user to quickly detach the socket of interest from the utility belt and then easily reattach the socket once its use is no longer required. Not only does such a system provide for greater efficiency, but is also less cumbersome and weighty than prior art systems which require an entire tool box, in essence, to be carried about with the worker.

What is claimed is:

1. A socket retainer, comprising:

an elongated body having a channel longitudinally disposed therein;

a lever arm pivotally attached to the elongated body within the channel, the lever arm including a lip adapted to engage a socket to retain the socket to the elongated body;

a spring disposed within the channel between the lever arm and the elongated body to bias the lever arm out of the channel and cause the lip to engage the socket;

a lock bar spanning the channel to retain the lever arm therein to counter the biasing force of the spring; and means for attaching the socket retainer to a utility belt.

2. The socket retainer of claim 1 wherein the attaching means is an aperture through the elongated body adapted to receive a strand of wire therethrough.

3. The socket retainer of claim 1 wherein the lever arm further includes a head adapted to protrude through the channel to allow a user to depress the lever arm to facilitate detachment of the socket from the retainer.

4. The utility belt of claim 1 wherein each socket retainer includes an elongated body including a first end and a second end, the means for releasably attaching a socket located proximate the second end, and means for attaching the socket retainer to the strand of wire.

5. A utility belt adapted to store sockets of varying size in independent fashion and allow quick release of the sockets therefrom, the utility belt, comprising:

a strand of wire strung from the utility belt;

a plurality of socket retainers attached to the strand of wire, each socket retainer including an elongated body including a first end and a second end, means for releasably attaching a socket located proximate the second end, and means for attaching the socket retainers to the strand of wire, the elongated body further including a channel, the channel being open at the body second end, the means for releasably retaining the socket being disposed within the body channel; and means for releasing the strand of wire from the utility belt to add or subtract individual socket retainers.

6. The utility belt of claim 5, wherein the means for releasably retaining the socket is a lever arm disposed within the body channel which is pivotally attached to the elongated body proximate the second end.

7. The utility belt of claim 6 further including a spring loaded between the lever arm and the body channel, the lever arm including a head protruding through the channel as a result of the spring.

8. The utility belt of claim 7 further including a lock bar spanning the body channel, the lever arm being held within the body channel between the spring and the lock bar.

9. The utility belt of claim 8 wherein the lever arm further includes a lip proximate the second end, the lip adapted to protrude through the body channel and engage a socket for retention thereof when the spring is expanded, the lip adapted to recede into the body channel to release the socket when the spring is compressed.

10. The utility belt of claim 9 wherein each socket retainer includes an aperture through which the strand of wire is strung.

11. The utility belt of claim 10 wherein the elongated body is square in cross-section.

12. A socket retaining mechanism comprising:

an elongated body including a first end, a second end, and a channel, the channel being open at the body second end;

means for releasably retaining a socket located proximate the second end, the means for releasably retaining the socket being disposed within the body channel; and means for attaching the socket retaining mechanism to a utility belt; and wherein the means for releasably retaining the socket is a lever arm disposed within the body channel which is pivotally attached to the elongated body proximate the second end.

13. The socket retaining mechanism of claim 12 further including a spring loaded between the lever arm and the body channel, the lever arm including a head protruding through the channel as a result of the spring.

14. The socket retaining mechanism of claim 13 further including a lock bar spanning the body channel, the lever arm being held within the body channel between the spring and the lock bar.

15. The socket retaining mechanism of claim 14 wherein the lever arm further includes a lip proximate the second end, the lip adapted to protrude through the body channel and engage a socket for retention thereof when the spring is expanded, the lip adapted to recede into the body channel to release the socket when the spring is compressed.

16. The socket retaining mechanism of claim 15 wherein the means for attaching the socket retaining mechanism to a utility belt includes an aperture proximate the first end through which the utility belt can pass.

17. The socket retaining mechanism of claim 16 wherein the elongated body is square in cross-section.

* * * * *